US005647960A

United States Patent [19]

Kotitschke

[11] Patent Number: 5,647,960

[45] Date of Patent: Jul. 15, 1997

[54] PRESS SECTION AND METHOD FOR STARTING AND OPERATING THEREOF

[75] Inventor: Gerhard Kotitschke, Steinheim, Germany

[73] Assignee: J.M. Voith GmbH, Heidenheim, Germany

[21] Appl. No.: 323,103

[22] Filed: Oct. 14, 1994

[30] Foreign Application Priority Data

Oct. 14, 1993 [DE] Germany ..... 43 35 024.0

[51] Int. Cl.[6] ..... D21F 3/04

[52] U.S. Cl. ..... 162/360.2; 162/358.1; 162/358.3

[58] Field of Search ..... 162/358.1, 358.3, 162/360.2, 360.3, 359.1

[56] References Cited

U.S. PATENT DOCUMENTS

| | | | |
|---|---|---|---|
| 3,268,390 | 8/1966 | Ely, Sr. | 162/306 |
| 4,075,056 | 2/1978 | Ely et al. | 162/305 |
| 4,874,470 | 10/1989 | Skaugen | 162/360.3 |
| 4,966,653 | 10/1990 | Rantala et al. | 162/273 |
| 5,124,000 | 6/1992 | Stenvall | 162/360.3 |
| 5,178,732 | 1/1993 | Steiner et al. | 162/360.2 |
| 5,308,450 | 5/1994 | Braun et al. | 162/360.2 |
| 5,368,697 | 11/1994 | Steiner et al. | 162/360.2 |
| 5,393,383 | 2/1995 | Karvinen et al. | 162/360.3 |

FOREIGN PATENT DOCUMENTS

| | | |
|---|---|---|
| 107 606 | 5/1984 | European Pat. Off. . |
| 348 373 | 12/1989 | European Pat. Off. . |

*Primary Examiner*—Donald E. Czaja
*Assistant Examiner*—Calvin Padgett
*Attorney, Agent, or Firm*—Marhsall, O'Toole, Gerstein, Murray & Borun

[57] ABSTRACT

A press section of a paper machine includes a pick-up roll, a take-off felt looping about at least the pick-up roll and a connected first pressing element, and a counter element assigned to the first pressing element. The counter element and the first pressing element define a first press unit. A first pressing felt loops about at least the counter element of the first press unit and a second pressing element with a smooth surface. The second pressing element forms a second press unit with the first pressing element. The press section also includes a smooth press belt partially looping around a portion of the second pressing element, a third pressing element looped about by the smooth press belt, and a third counter element assigned to the third pressing element. The third counter element and the third pressing element form a third press unit. A third pressing felt loops about at least the third counter element. A take-off device disposed downstream the third pressing unit with respect to a direction of conveyance of a paper web through the press section is disposed against the smooth press belt.

11 Claims, 2 Drawing Sheets

PRESS SECTION AND METHOD FOR STARTING AND OPERATING THEREOF

BACKGROUND OF THE INVENTION

1. Field of the Invention

The invention relates to press sections of a paper machine and methods for starting and operating such press sections.

2. Description of Related Technology

Paper machine press sections are known, for example, from EP 107,606. According to FIG. 1 of EP 107,606, press roll pairs are provided, each of which forms a press gap or nip. A continuous felt belt that takes up water from the web, which is known as a "dewatering felt," travels through each press gap. Additionally, an impervious, continuous loop pressing belt travels through both press gaps in succession and through some guide rolls. The web to be dewatered comes into contact with the belt in the first press gap and then it is guided by the belt to the second press gap. In this configuration, directly behind each of the two press gaps (i.e. directly downstream of the press gaps with respect to a direction of travel of the web), the dewatering felt cooperating with the press gap separates from the web to be dewatered and thus the transport of the web occurs entirely without the involvement of the dewatering felt. As a result of this, remoistening of the web from the dewatering felts is avoided. In this way, an attempt is made to increase the dewatering capacity of the press part, i,e., to have the web at a higher dry content when it leaves the press part. The disadvantages of such a configuration and other known press parts is that upon starting the press part, blockages and the related operational disturbances sometimes occur, or the course of the paper web is not unequivocally defined, causing disturbances in the operation of the press section.

Furthermore, in spite of the fact that many press section embodiments are known in the art, there is still a demand to increase the performance of known press sections, especially with respect to web dry content, optimum web guidance, symmetrical dewatering, and especially uniformity of the properties of the two sides of the paper web.

SUMMARY OF THE INVENTION

It is an object of the invention to overcome one or more of the problems described above. It is also an object of the invention to provide a press section of a paper machine and method of use thereof which provides trouble free start-up of the press section. It is a further object of the invention to provide a combination of known machine elements in a press section, resulting in a higher dry content of the paper web, tension-free web guidance, symmetrical dewatering of the web and, as a result of this, maximum uniformity on the two sides of the paper with regard to roughness and oil uptake.

According to the invention, a press section of a paper machine includes a pick-up roll, a take-off felt looping about at least the pick-up roll and a connected first pressing element, and a counter element assigned to the first pressing element. The counter element and the first pressing element define a first press unit. A first pressing felt loops about at least the counter element of the first press unit and a second pressing element with a smooth surface. The second pressing element forms a second press unit with the first pressing element. The press section also includes a smooth press belt partially looping around a portion of the second pressing element, a third pressing element looped about by the smooth press belt, and a third counter element assigned to the third pressing element. The third counter element and the third pressing element form a third press unit. A third pressing felt loops about at least the third counter element. A take-off device disposed downstream the third pressing unit with respect to a direction of conveyance of a paper web through the press section is disposed against the smooth press belt.

Also according to the invention, a method of starting and operating a press section is provided.

Other objects and advantages of the invention will be apparent to those skilled in the art from the following detailed description taken in conjunction with the drawings and the appended claims.

DETAILED DESCRIPTION OF THE INVENTION

Figure 1:
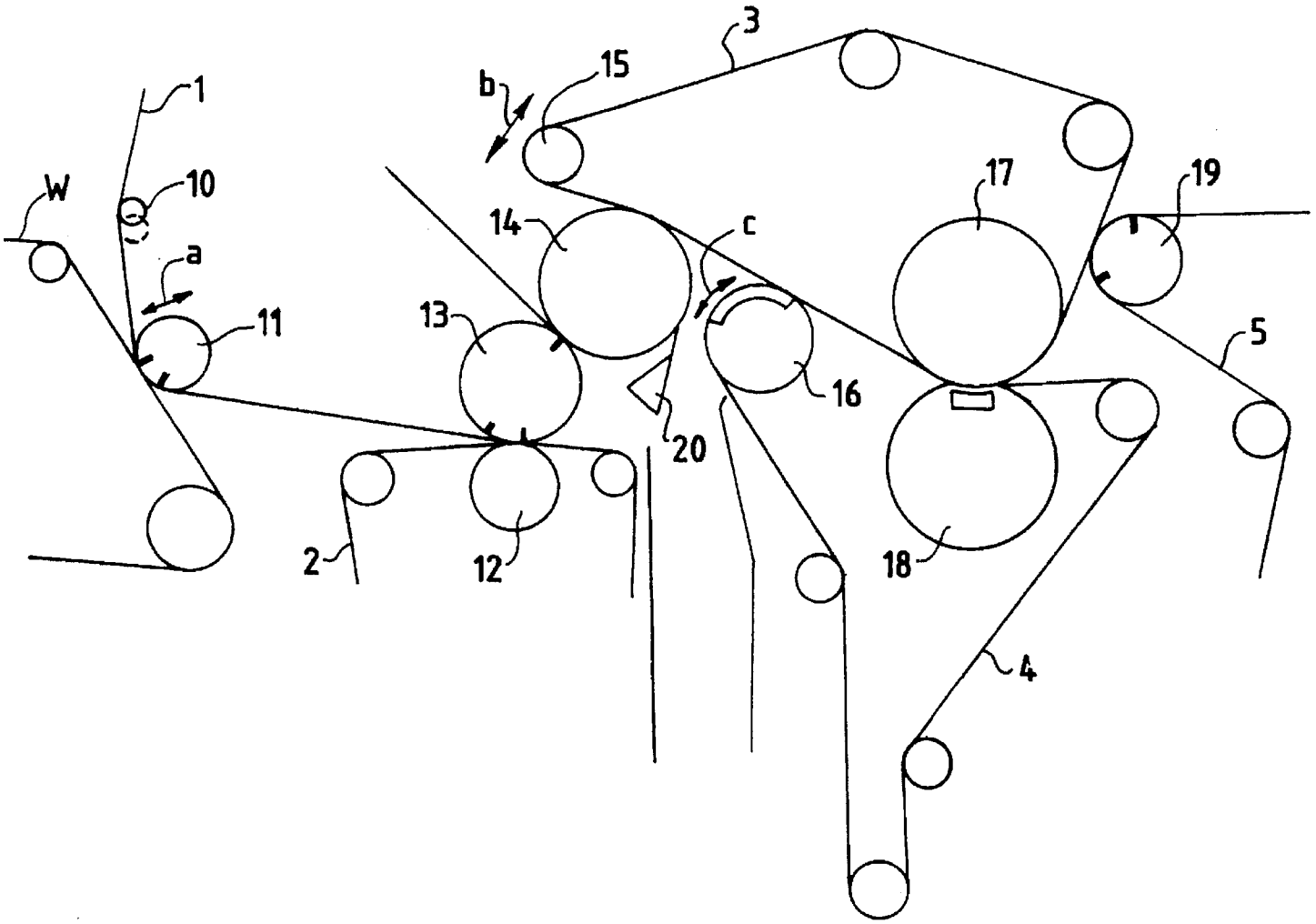
FIG. 1 is a schematic view of a press section according to the invention.

FIG. 1 illustrates a press section according to the invention in which a sheet-forming wire having a paper web W thereon is deflected over two rolls. The paper web W is taken off the wire by a take-off felt 1 at a pick-up roll 11. The take-off felt comes from a top portion of the press section, is deflected by a bent felt spreader roll 10, and wraps about the pick-up roll 11. The pick-up roll 11 may be swivelable as indicated by a double arrow "a" Downstream of the pick-up roll 11 with respect to the direction of travel of the web W, the paper web W is introduced to a first press unit in the form of a double-felted press gap or nip defined by rolls 12 and 13. The take-off felt 1 is looped about the roll 13 and the counter roll 12 is looped about by a pressing felt 2. After (i.e., downstream with respect to the direction of conveyance of the web through the section) this first double-felted press gap, the paper web W adheres to the take-off felt 1 lying against the roll 13 and is conveyed to a second press unit in the form of a gap or nip defined by a smooth press roll 14 and the roll 13. The smooth press roll 14 takes up the paper web and guides the web to a smooth press belt 3. A doctor blade device 20 is disposed adjacent to the roll 14 at a location downstream of a contact point between the roll 14 and the press belt 3. The press belt 3 is advanced in a direction toward the roll 14 via a swivelable roll 15 as indicated by the double arrow "b". The press belt takes over the paper web W at the roll 14 and introduces the web to a third press unit. The third press unit is a gap or nip defined by a counter roll 17 and an extended nip press or shoe press unit 18. The counter roll 17 is in the loop of the smooth press belt 3 while the shoe press unit 18 is in a loop formed by a press felt 4. The press felt 4 is introduced to the third press gap 17/18 via a suction roll 16 disposed between the rolls 14 and 18. The roll 16 can be swivelable as illustrated by the double arrow "c". The press felt 4 travels along the same path as the smooth press belt 3 between the roll 16 and the press gap 17/18, so that, after the roll 16, the paper web is guided into the press gap 17/18 while being sandwiched between the felt 4 and the belt 3. After the press gap 17/18, the press felt 4 is immediately removed from the paper web W in order to avoid remoistening of the web. The web W is then conveyed with the smooth press belt 3 to a next deflecting roll. Between the roll 17 and the subsequent deflecting roll, the paper web is picked up by a take-off device illustrated in FIG. 1 by a felt which is pressed against the smooth press belt 3 by a deflecting roll 19. The web W is then guided to further processing. Preferably, the deflecting roll 19 is designed as a suction roll.

The following is a description of a method according to the invention for the start-up of the press section shown in FIG. 1:

(a) Upon start-up of the press section, i.e., swinging the pick-up roll 11 into the wire, it must be ensured that the initial paper web can be guided without difficulty into a broke chest for an amount of time. For this purpose, it is necessary that the guide roll 15 in the press belt 3 can be swung away from the smooth press roll 14 so that there is no contact between the press belt 3 and the roll 14 and the paper web can run all the way to a take-off doctor 20 and then into a broke chest (not shown).

(b) Upon reaching stable running conditions, a transfer strip is cut from the paper web on the wire with a strip cutting device. Then, the press belt 3 is swung toward the press roll 14 and the cut paper strip can be separated from the roll surface directly after a tangent point between the belt 3 and the roll 14 with the aid of an air-blow transfer device which blows the paper onto the press belt. In order to transfer the strip to the smooth press belt 3, it may be necessary to moisten the belt 3 in order to increase adhesion thereto.

(c) It is possible to perform the transfer of the web strip to the belt 3 discussed in paragraph (b) above with a small distance between the press roll 14 and the press belt 3 to ensure that the self-transfer of a full web width is not possible.

(d) At a distance which is as close as possible to the take-off point (i.e., the point where the web leaves the roll 14 and is transferred to the belt 3), the paper web adhering to the press belt 3 is supported by the press felt 4, that is, it is guided between the felt 4 and the press belt 3 so that it cannot separate from the press belt 3 during transport to the next roll press or shoe press. This means that downstream of the take-off point, the paper web is guided to the next press gap sandwiched between the felt 4 and the belt 3.

(e) The first felt guide roll 16 where the sandwiched transport of the paper web begins can be a smooth, grooved, perforated, or suction roll.

(f) The guide roll 16 described in paragraph (e) can be swivelable to provide for the setting of a small gap between the felt 4 and the press belt 3 so that an air film that is drawn between the felt 4 and press belt 3 can be removed on the side later, and that a width-stretch action of the paper web occurs as a result.

(g) Directly downstream of the take-off point onto the smooth belt, a blowing nozzle that extends over the entire width of the machine can be provided to produce an excess of pressure which facilitates the transfer process and prevents tearing of the web.

(h) The looping of the press belt 3 onto the press roll 14 must be minimal so that a differential velocity between the press roll 14 and the press belt 3 can be set.

(i) Downstream of the shoe press 18, the transfer strip of the paper web is first directly drawn to and taken by a suction roll of a first drying screen and guided to a doctor of a first drying cylinder from which the web is guided away on a broke-handling belt disposed thereunder and then into another broke chest or a cellar.

(j) A blowing device can support the transfer of the paper web to a first dryer felt.

(k) The guide roll 15 in the press belt upstream of the take-up point can be swivelable in order to optimize transfer.

(l) The common press belt/dryer wire contact section must be minimal in order to make possible a significant advance of the first dryer wire 5 in comparison to the press belt. This is necessary so as to pre-stress the paper web correspondingly before the first dryer group. The extending section for the paper is the section of paper between the shoe press 18 and the contact section between drying cylinder/dryer felt.

(m) When the transfer strip of the paper web runs stably through the dryer portion of the machine, one can operate with the strip cutting device on the wire at "full width", i.e., from strip position to the drive side. As a result of this, the full web width will run through the machine automatically.

(n) When a broke chest is present under cylinder 14, one can operate at "full width" immediately after transfer of the strip through the shoe press 18 to the cylinder 19.

Figure 2:
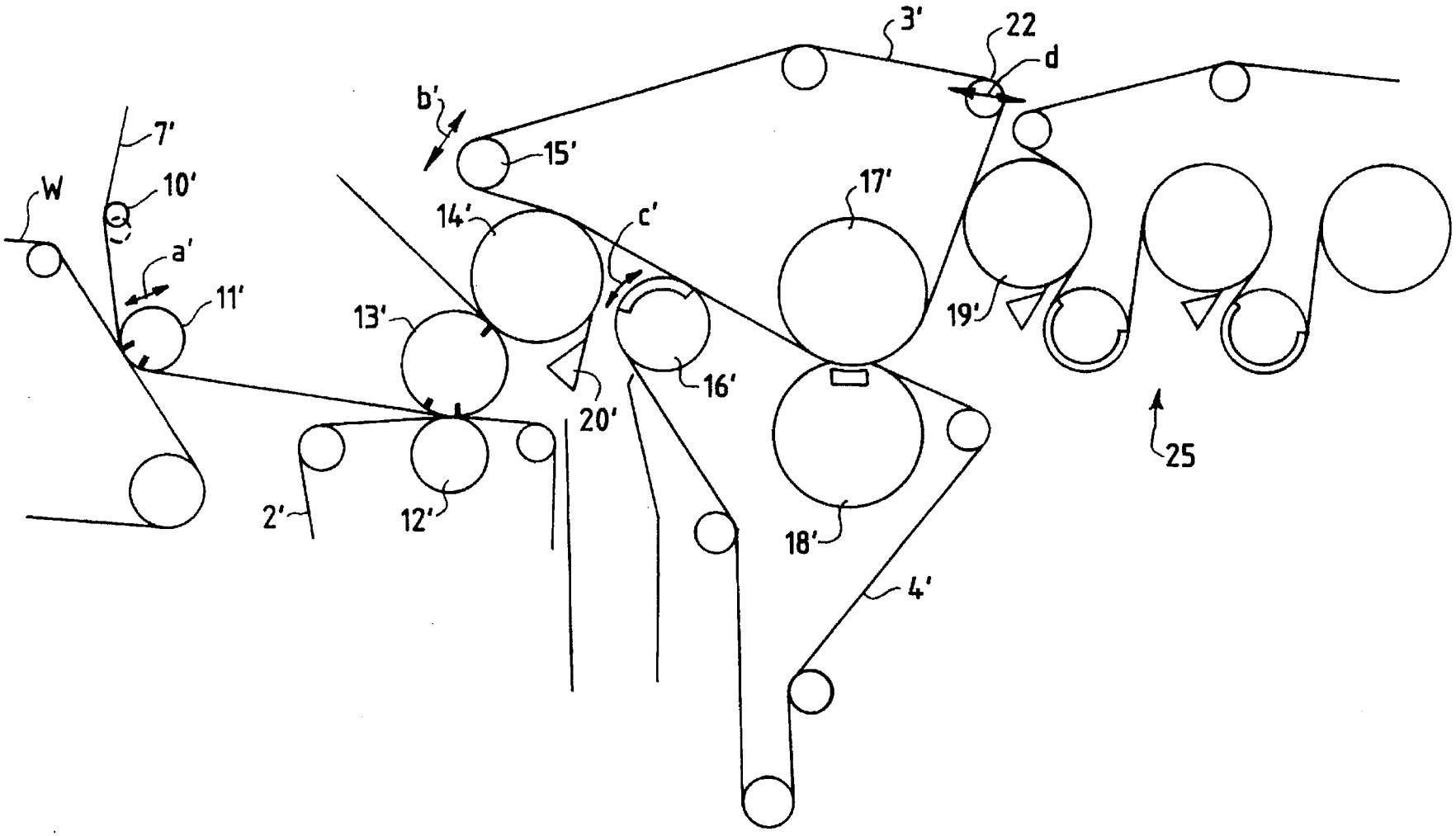
FIG. 2 is a schematic view of a second embodiment of a press section according to the invention.

FIG. 2 shows a press section having elements, 1'–4', 10'–18', and 20' similar in function and design to the elements, 1–4, 10–18, and 20, respectively, shown in FIG.1. However, the take-off of the paper web W from the smooth press belt 3' is done directly via a first cylinder 19' of a connected dryer group.

The following is a description of a method according to the invention for the start-up of the press section shown in FIG. 2:

(a) Upon start-up of the press section, i.e., swinging the pick-up roll 11' into the wire, it must be ensured that the initial paper web can be guided without difficulty into a broke chest for an amount of time. For this purpose, it is necessary that the guide roll 15' in the press belt 3' can be swung away from the smooth press roll 14' so that there is no contact between the press belt 3' and the roll 14' and the paper web can run all the way to a take-off doctor 20' and then into a broke chest (not shown).

(b) Upon reaching stable running conditions, a transfer strip is cut from the paper web on the wire with a strip cutting device. Then, the press belt 3' is swung toward the press roll 14' and the cut paper strip can be separated from the roll surface directly after a tangent point between the belt 3' and the roll 14' with the aid of an air-blow transfer device which blows the paper onto the press belt. In order to transfer the strip to the smooth press belt 3', it may be necessary to moisten the belt 3' in order to increase adhesion thereto.

(c) It is possible to perform the transfer of the web strip to the belt 3' discussed in paragraph (b) above with a small distance between the press roll 14' and the press belt 3' to ensure that the self-transfer of a full web width is not possible.

(d) At a distance which is as close as possible to the take-off point (i.e., the point where the web leaves the roll 14' and is transferred to the belt 3'), the paper web adhering to the press belt 3' is supported by the press felt 4', that is, it is guided between the felt 4' and the press belt 3' so that it cannot separate from the press belt 3' during transport to the next roll press or shoe press. This means that downstream of the take-off point, the paper web is guided to the next press gap sandwiched between the felt 4' and the belt 3'

(e) The first felt guide roll 16' where the sandwiched transport of the paper web begins can be a smooth, grooved, perforated, or suction roll.

(f) The guide roll 16' described in paragraph (e) can be swivelable to provide for the setting of a small gap between the felt 4' and the press belt 3' so that an air film that is drawn between the felt 4' and press belt 3' can be removed on the side later, and that a width-stretch action of the paper web occurs as a result.

(g) Directly downstream of the take-off point onto the smooth belt, a blowing nozzle that extends over the entire width of the machine can be provided to produce an excess of pressure which facilitates the transfer process and prevents tearing of the web.

(h) The looping of the press belt 3' onto the press roll S 14' must be minimal so that a differential velocity between the press roll 14' and the press belt 3' can be set.

(i) Downstream of the shoe press 18', the transfer strip of the paper web is first directly drawn to and taken by a suction roll of a first drying screen and guided to a doctor of a first drying cylinder from which the web is guided away on a broke-handling belt disposed thereunder and then into another broke chest or a cellar.

(j) A blowing device can support the transfer of the paper web to a first dryer felt.

(k) A guide roll 22 in the press belt disposed downstream of the take-up point can be swivelable (as indicated by the double arrow "d") in order to optimize transfer.

(l) The common press belt/dryer cylinder contact section must be minimal in order to make possible a significant advance of a first dryer group, generally 25, in comparison to the press belt 3'. This is necessary so as to pre-stress the paper web correspondingly before the first dryer group. The extending section for the paper is the section of paper between the shoe press 18' and the contact section between drying cylinder/dryer felt.

(m) When the transfer strip of the paper web runs stably through the dryer portion of the machine, one can operate with the strip cutting device on the wire at "full width", i.e., from strip position to the drive side. As a result of this, the full web width will run through the machine automatically.

(n) When a broke chest is present under cylinder 14', one can operate at "full width" immediately after transfer of the strip through the shoe press 18' to the cylinder 19'.

In summary, the press sections according to the invention shown in FIGS. 1 and 2 have the following advantages:

strip transfer or web transfer can be performed in stages;

the strip or full web width can be guided away from the pressing elements without difficulty;

after each transfer point, where the paper becomes longer, a positive velocity difference can be set and, in spite of this, the paper web is fully supported.

The foregoing detailed description is given for clearness of understanding only, and no unnecessary limitations should be understood therefrom, as modifications within the scope of the invention will be apparent to those skilled in the art.

I claim:

1. A press section of a paper machine comprising:

(a) a pick-up roll;

(b) a take-off felt looping about at least the pick-up roll and a connected first pressing element;

(c) a counter element assigned to the first pressing element, said counter element and said first pressing element defining a first press unit;

(d) a first pressing felt looping about at least the counter element of the first press unit;

(e) a second pressing element with a smooth roll with a smooth surface, said smooth surfaced roll for directly contacting a web and forming a second press unit with the first pressing element;

(f) a smooth press belt partially looping around a portion the second pressing element;

(g) a third pressing element looped about by the smooth press belt;

(h) a third counter element assigned to the third pressing element, said third counter element and said third pressing element forming a third press unit;

(i) a third pressing felt looping about at least the third counter element; and (j) a take-off device downstream the third pressing unit with respect to a direction of conveyance of a paper web through the press section, said take-off device lying against the smooth press belt.

2. The press section of claim 1 wherein the pick-up roll is swivelable.

3. The press section of claim 1 further comprising:

(a) a doctor disposed on the smooth press roll, following a contact point to the smooth press belt; and (b) a swivelable guide roll disposed in the loop of the smooth press belt upstream of the contact point to the smooth press roll.

4. The press section of claim 1 wherein a second guide roll is disposed in the loop of the third press felt and downstream of the contact point of the smooth roll and the smooth press belt, said smooth press belt and said third press felt being adapted to sandwich a paper web while advancing the web into the third press unit.

5. The press section of claim 4 wherein the second guide roll is a suction roll.

6. The press section of claim 4 wherein the second guide roll is swivelable.

7. The press section of claim 1 wherein the take-off device is a felted suction guide roll.

8. The press section of claim 1 wherein the take-off device is a first drying cylinder of a downstream dryer group.

9. The press section of claim 1 wherein at least one of the press units is at least one of an extended-nip press and a shoe press.

10. The press section of claim 1 wherein the third pressing element is a shoe press.

11. A press section of a paper machine comprising:

(a) means defining a first, double-felted press gap with symmetrical dewatering and compression of outer layers of a paper web:

(b) means defining a second press gap wherein a bottom side of a paper web is directly contacted and pressed on a smooth pressing surface of a press roll;

(c) means for providing a tension-free, supported web transfer from the second press gap into a third press gap; and (d) means defining a third press gap wherein a top side of the paper web is pressed against a smooth presssing surface of a press belt, said third press gap being an extended-nip press.

* * * * *